US005442923A

United States Patent [19]

Bareiss

[11] Patent Number: 5,442,923

[45] Date of Patent: Aug. 22, 1995

[54] ROTARY COMPRESSOR OR ROTARY DISPLACEMENT PUMP

[75] Inventor: Martin Bareiss, Lauffen am Neckar, Germany

[73] Assignee: Licentia Patent-Verwaltungs-GmbH, Frankfurt, Germany

[21] Appl. No.: 145,740

[22] Filed: Nov. 4, 1993

[30] Foreign Application Priority Data

Nov. 12, 1992 [DE] Germany ..... 42 38 166.5

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS 3,474,641 10/1969 Granryd ..... 62/6
3,488,945 1/1970 Kelly ..... 62/6
3,509,718 5/1970 Fezer et al. ..... 62/6

FOREIGN PATENT DOCUMENTS 3333586 4/1985 Germany .
3602634 7/1987 Germany .
3909831 9/1990 Germany .
3245974 7/1992 Germany .
4129772 10/1992 Germany .

OTHER PUBLICATIONS

Patent Abstracts of Japan, M-1124 Jun. 13, 1991, vol. 15, No. 232, JP 3-70941 A.

*Primary Examiner*—Ronald C. Capossela
*Attorney, Agent, or Firm*—Spencer, Frank & Schneider

[57] ABSTRACT

A rotary fluid displacement machine includes a stator having a wall provided with an inner wall face defining a work chamber; shaft bearings supported in the stator; a rotor; a rotor drive shaft secured to the rotor and supported by the shaft bearings; and vanes secured to the rotor for revolving therewith. The vanes divided the work chamber into at least two compartments. The rotor is provided with a gas channel having a first end opening to the exterior in a zone of one of the bearings and a second end opening to a surface of the rotor for communicating with the compartments.

6 Claims, 3 Drawing Sheets

ROTARY COMPRESSOR OR ROTARY DISPLACEMENT PUMP

CROSS REFERENCE TO RELATED APPLICATION

This application claims the priority of Germany Application No. P 42 38 166.5 filed Nov. 12, 1992, which is incorporated herein by reference.

BACKGROUND OF THE INVENTION

This invention relates to a rotary compressor or rotary displacement pump (hereafter collectively also referred to as a rotary fluid displacement machine) including a stator which defines work chambers and further has a bearing for a drive shaft; a rotor mounted on the drive shaft and operating according to the rotary vane principle. The rotor divides the work chamber into at least two compartments. The invention further relates to a gas refrigerating machine which includes such compressor or pump and which operates according to the Stirling or Vuilleumier principle.

Rotary fluid displacement machines of the above-outlined type operate preponderantly according to the rotary vane principle. The fluid inlet and the outlet are provided in the stator in a stationary manner such that a substantially constant vacuum and, respectively, pressure prevails at the inlet and outlet. The use of these structures for gas refrigerating machines is therefore only conditionally possible.

Thus, regenerative gas refrigerating machines which operate according to the Stirling or the Giffort-McMahon principle preponderantly use piston pumps.

The use of such regenerative gas refrigerating machines is at the present time limited to the cryogenic temperature range (below −100° C.) because in the higher temperature range (between 100° C. and 0° C.) the competitiveness of these machines compared to the conventionally widely used cold vapor principle is questionable. As a reason the relatively high technological input of regenerative gas refrigerating machines is cited.

A diagrammatic illustration of a conventional gas refrigerating machine operating according to the Stirling principle is shown in FIGS. 1 and 2.

The conventional gas refrigerating machine includes a compressor 1, a displacement pump 2, a heat releasing heat exchanger 3, a regenerator 4 and a heat absorbing heat exchanger 5. The displacement piston 2 separates the cylinder 6 into a cold chamber 7 and a warm chamber 8. As shown in FIG. 1, the components are coupled to one another by means of a gas conduit which, similarly to the work chambers, is filled with a gaseous medium, also referred to as the working gas. To obtain the cyclic refrigeration process, the piston of the compressor 1 and the piston of the displacement pump 2 have to move in a coordinated manner. For this purpose, because of technological boundary conditions, as a rule harmonic motions are chosen in which the phase shift in the motions of the two pistons is one-fourth of a cycle as shown in FIG. 2 which illustrates the volume variation of the compression chamber (curve 9), the cold chamber (curve 11) and the warm chamber (curve 10) as a function of time.

The mechanical drive of the compressor and pump pistons is effected in conventional structures by a relatively complex cranking mechanism and a common drive shaft.

SUMMARY OF THE INVENTION

It is an object of the invention to provide an improved rotary fluid displacement machine of the above-outlined type with which improved pressure conditions may be achieved with simpler structural means and which is particularly adapted for use in a regenerative gas refrigerating machine.

This object and others to become apparent as the specification progresses, are accomplished by the invention, according to which, briefly stated, the rotary fluid displacement machine includes a stator having a wall provided with an inner wall face defining a work chamber; shaft bearings supported in the stator; a rotor; a rotor drive shaft secured to the rotor and supported by the shaft bearings; and vanes secured to the rotor for revolving therewith. The vanes divide the work chamber into at least two compartments. The rotor is provided with a gas channel having a first end opening to the exterior in a zone of one of the bearings and a second end opening to a surface of the rotor for communicating with the compartments.

The rotary fluid displacement machine structured according to the invention has the advantage over conventional regenerative gas refrigerating machines in that it has a compact, low-vibration structure. It is a further significant advantage of the invention that the machine has a large surface/volume ratio of the compressing or displacement chambers. It enhances, together with intensive gas motions in these chambers, a superior heat exchange with the stator wall so that the latter may additionally serve as a heat exchanger. The isothermal condition changes ideal for the Stirling process may be approximated better than in conventional constructions.

DESCRIPTION OF THE PREFERRED EMBODIMENTS

Figure 3:
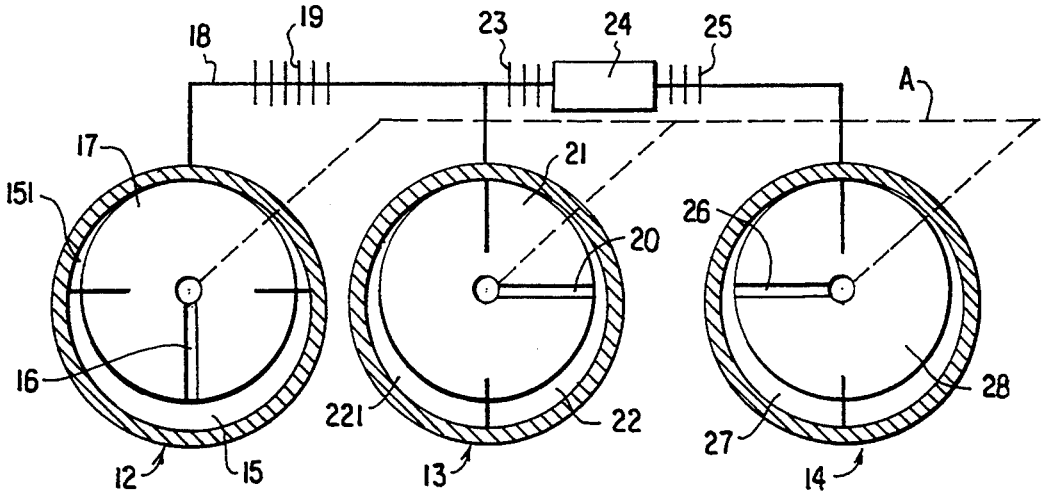
FIG. 3 is a schematic representation of a first gas refrigerating system incorporating the invention.

Turning to FIG. 3, there is illustrated therein a refrigerating system which includes a compressor 12, a warm displacement pump 13 and a cold displacement pump 14. All three components 12, 13 and 14 are rotary vane machines, the respective rotors of which are mounted on a common drive shaft (symbolically shown at A).

The illustration of FIG. 3 and the description which follows is based, as an example, on a two-compartment construction, although it will be understood that machines having more than two compartments may be expedient and may incorporate the invention.

The compressor chamber 15 is coupled by a channel 16 with a conduit 18. The conduit 18 extends to the warm chamber 22 of the pump 13 from the compressor 12 and passes through a heat exchanger 19 and a channel 20. A further fluid path leads through a heat exchanger 23, a regenerator 24, a heat exchanger 25 and a channel 26 to the cold chamber 27 of the pump 14.

Figure 4:
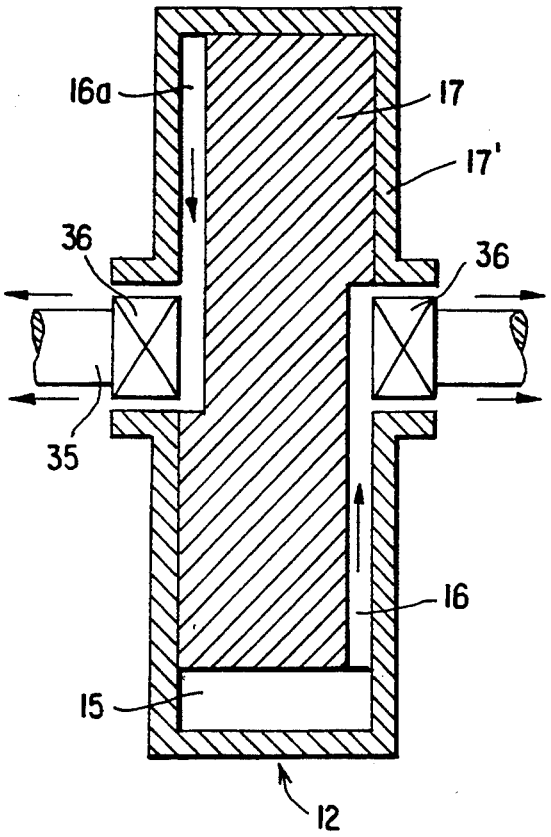
FIG. 4 is a schematic sectional view of a rotary fluid displacement machine according to a preferred embodiment of the invention.

The gas channels 16, 20 and 26 provided in the rotors 17, 21 and 28 of the respective rotary machines 12, 13 and 14 are brought to the exterior in the zone of the hub such that a flow passage cross section is ensured that is independent from the rotary angle. FIG. 4 shows an exemplary course of the channel 16 for the compressor 12.

Figure 1:
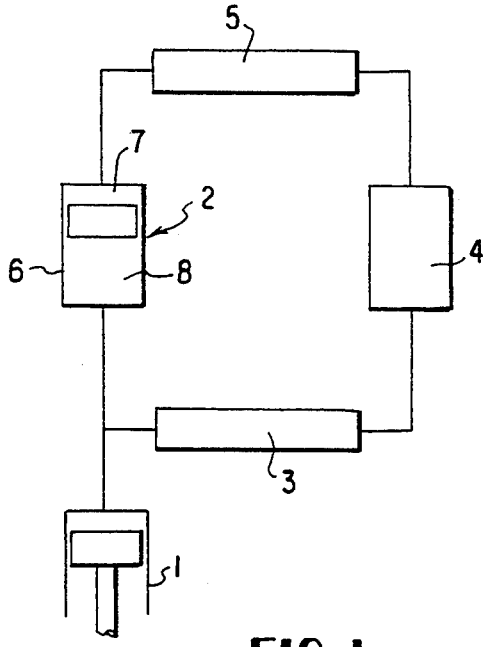
FIG. 1 (PRIOR ART)
FIG. 1 is a diagrammatic representation of a gas refrigerating system according to the prior art.
Figure 2:
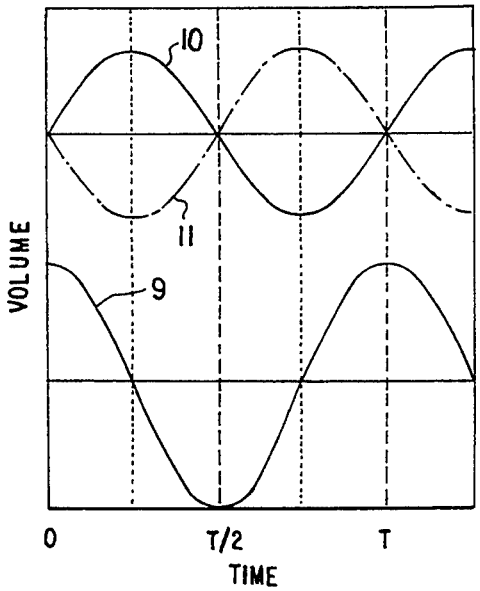
FIG. 2 is a graph illustrating the volume/time functions of the rotary fluid displacement machines forming part of the system according to FIG. 1.

As the rotors 17, 21 and 28 rotate synchronously, the compression chamber 15, the warm chamber 22 and the cold chamber 27 change in volume in accordance with the curves 9, 10 and 11 illustrated in FIG. 2. The correct phase position of the curve 10 or 11 relative to curve 9 is obtained from the 90° or, respectively, 270° offset in the angular position of the two displacement rotors 21 and 28.

Figure 3A:
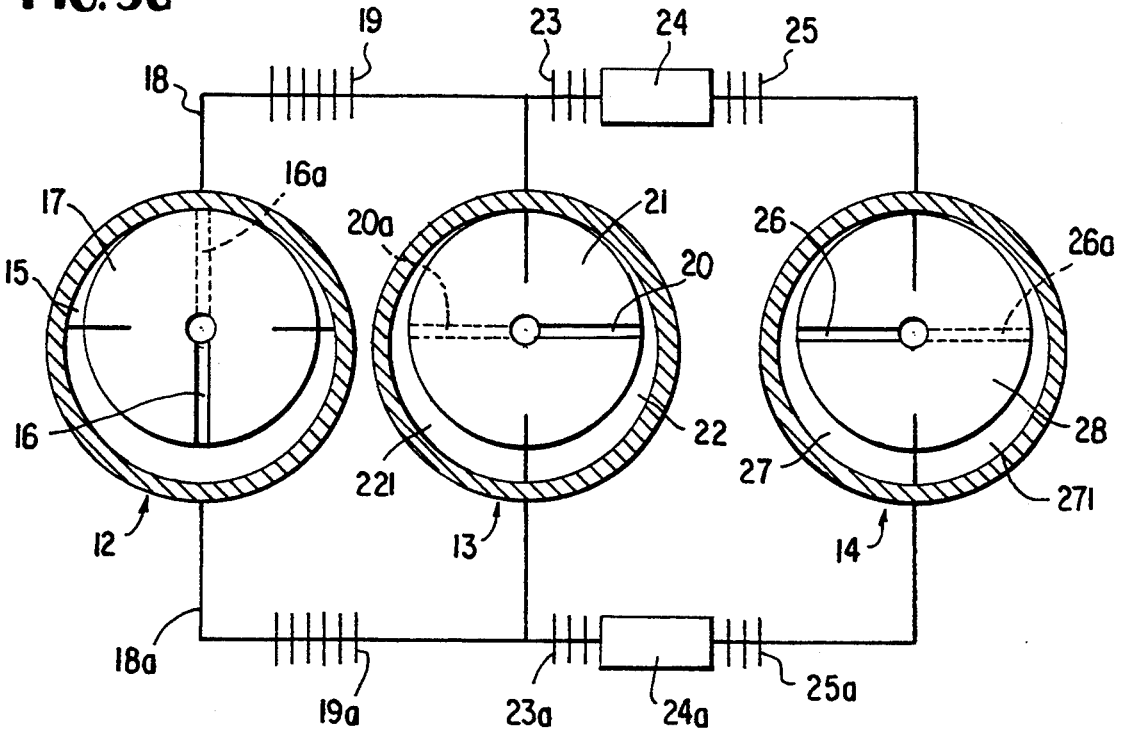
FIG. 3*a* is a schematic representation of a second gas refrigerating system incorporating the invention.

Turning to FIG. 3*a*, the momentarily second cell of the compressor 12 and the two displacement pumps 13 and 14 are expediently used for a second gas refrigerating subsystem which operates with a 180° phase shift relative to the first subsystem (constituting the entire system in FIG. 3). The duplicated components for such a second refrigerating subsystem are given the same reference numerals as the components of the first subsystem, complemented with the suffix a.

In the embodiments shown in FIGS. 3 and 3*a* the rotors 17, 21 and 28 have a pair of diametrically arranged vanes which divide the work chambers into compartments 15, 151; 22, 221; and 27, 271, respectively.

FIG. 4 illustrates schematically a rotary fluid displacement machine (here designated at 12) structured according to the invention. A rotor 17 is accommodated in a stator 17'. The rotor 17 is mounted on a drive shaft 35 which, in turn, is supported by bearings 36 mounted in the stator 17'. In the rotor 17 a gas channel 16 is provided which has one end that opens to the exterior in the hub (or bearing) zone and has another end which terminates on the peripheral surface of the rotor 17 and thus opens into the work chamber. A second gas channel 16*a* extending spaced from and at a 180 phase shift with respect to the gas channel 16 may also be provided. As seen in FIG. 4, the gas channels 16, 16*a* are free from valves.

Figure 5:
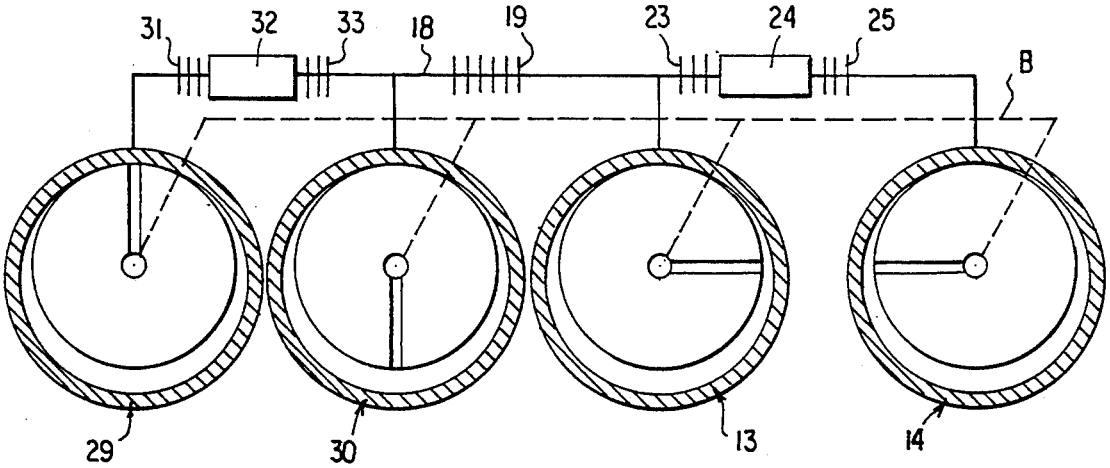
FIG. 5 is a schematic representation of a third gas refrigerating system incorporating the invention.

The rotary vane principle according to the invention may be used in gas refrigerating machines that operate according to the Vuilleumier principle which is a further development of the Stirling principle. Such a refrigerating system is schematically illustrated in FIG. 5. Thus, instead of the compressor 12 shown in FIG. 3, two displacement pumps 29 and 30 having the structural features according to the invention are utilized which, together with the heat exchanger 31, the regenerator 32 and the heat exchanger 33, form a thermal compressor unit for generating a sinusoidal pressure condition. The compressor unit is, as shown, coupled to the regenerator/displacement unit shown in FIG. 3.

The four displacement pumps 29, 30, 13 and 14 are expediently mounted on a common drive shaft symbolically illustrated at B.

Figure 5A:
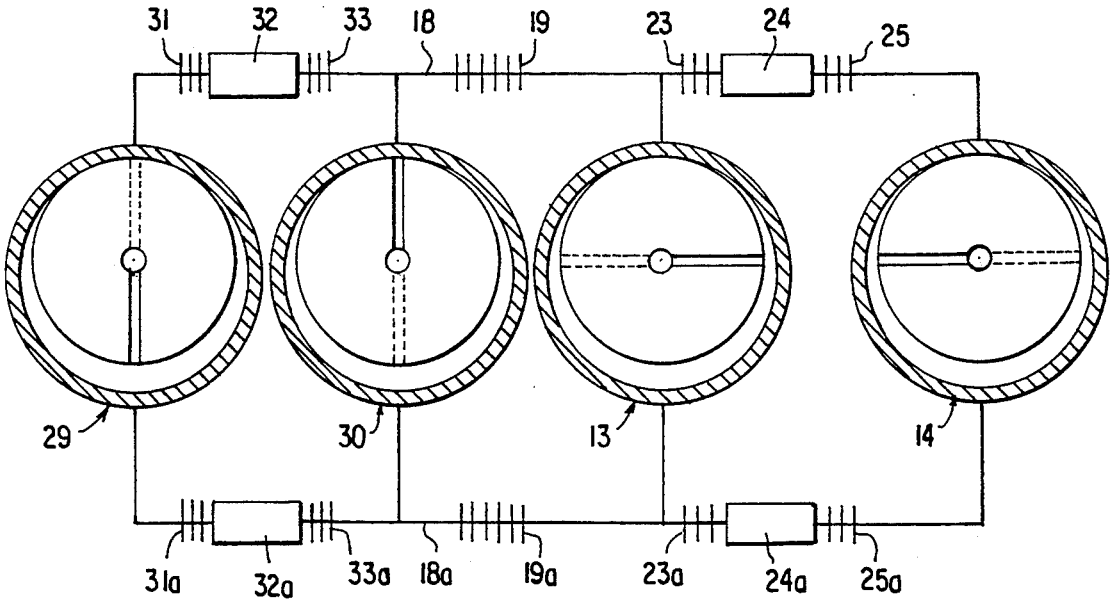
FIG. 5*a* is a schematic representation of a fourth gas refrigerating system incorporating the invention.

FIG. 5*a* illustrates an embodiment which utilizes the construction of FIG. 5 for a second, additional gas refrigerating subsystem similarly to the arrangement of FIG. 3*a*. The duplicated components for such a second refrigerating subsystem are given the same reference numerals as the components of the first subsystem (constituting the entire system in FIG. 5), complemented with the suffix a.

Because of the large surface/volume ratio of the compressing and displacing chambers, the separate heat exchangers 19, 19*a*, 23, 23*a* and 25, 25*a* may be partially or entirely omitted from the machine shown in FIGS. 3, 3*a* and likewise, the heat exchangers 31, 31*a*, 33, 33*a* of the systems shown in FIG. 5, 5*a* may be in part or entirely omitted which further reduces the technological input of the gas refrigerating system.

By virtue of the arrangement of the heat chambers 22, 22*a* and the cold chambers 27, 27*a* in the respective own displacement pumps 13 and 14 adjusted to the temperature level, the temperature exchange losses are minimized.

It will be understood that the above description of the present invention is susceptible to various modifications, changes and adaptations, and the same are intended to be comprehended within the meaning and range of equivalents of the appended claims.

What is claimed is:

1. In a rotary fluid displacement machine including a stator having a wall provided with an inner wall face defining a work chamber; shaft bearings supported in the stator; a rotor; a rotor drive shaft secured to said rotor and supported by the shaft bearings; and vanes secured to the rotor for revolving therewith; said vanes dividing said work chamber into at least two compartments; the improvement comprising a valve-free gas channel provided in said rotor; said gas channel having a first end opening to the exterior in a zone of one of said bearings and a second end opening to a surface of said rotor for communicating with said compartments.

2. The rotary fluid displacement machine as defined in claim 1, wherein said wall of said stator comprises a heat exchanger; said inner wall face constituting an inner heat exchange surface of the heat exchanger.

3. A gas refrigerating machine comprising a plurality of rotary fluid displacement machines each including a stator having a wall provided with an inner wall face defining a work chamber; shaft bearings supported in the stator; a rotor; a rotor drive shaft secured to said rotor and supported by the shaft bearings; vanes secured to the rotor for revolving therewith; said vanes dividing said work chamber into at least two compartments; and a valve-free gas channel provided in said rotor; said gas channel having a first end opening to the exterior in a zone of one of said bearings and a second end opening to a surface of said rotor for communicating with said compartments; one of said rotary fluid displacement machines being a compressor, one of said rotary fluid displacement machines being a warm displacement pump and one of said rotary fluid displacement machines being a cold displacement pump; said rotary fluid displacement machines being interconnected by gas conduits for operating according to the Stirling principle to generate sinusoidal changes of the volume of the work chambers of the rotary fluid displacement machines.

4. The gas refrigerating machine as defined in claim 3, wherein the rotor of said compressor and the rotor of at least one of the displacement pumps are mounted on a common drive shaft.

5. A gas refrigerating machine comprising a plurality of rotary fluid displacement machines each including a stator having a wall provided with an inner wall face defining a work chamber; shaft bearings supported in the stator; a rotor; a rotor drive shaft secured to said rotor and supported by the shaft bearings; vanes secured to the rotor for revolving therewith; said vanes dividing said work chamber into at least two compartments; and a valve-free gas channel provided in said rotor; said gas channel having a first end opening to the exterior in a zone of one of said bearings and a second end opening to a surface of said rotor for communicating with said compartments; one of said rotary fluid displacement machines being a first displacement pump; one of said rotary fluid displacement machines being a second displacement pump; one of said rotary fluid displacement machines being a third, warm displacement pump; and one of said rotary fluid displacement machines being a fourth, cold displacement pump; said rotary fluid displacement machines being interconnected by gas conduits for operating according to the Vuilleumier principle to generate sinusoidal changes of a system pressure and of the volume of the work chambers of said third and fourth displacement pumps.

6. The gas refrigerating machine as defined in claim 5, wherein the rotor of at least two of rotary fluid displacement machines are mounted on a common drive shaft.

* * * * *